US011400504B2

(12) United States Patent
Yoo et al.

(10) Patent No.: US 11,400,504 B2
(45) Date of Patent: Aug. 2, 2022

(54) MOLDED BODY MANUFACTURING METHOD

(71) Applicant: Hyundai Steel Company, Dong-gu (KR)

(72) Inventors: Byung Gil Yoo, Gyeonggi-Do (KR); Seung Ha Lee, Chungcheongnam-Do (KR); Hyeong-Hyeop Do, Chungcheongnam-Do (KR); Chee Woong Song, Seoul (KR)

(73) Assignee: Hyundai Steel Company, Incheon (KR)

( * ) Notice: Subject to any disclaimer, the term of this patent is extended or adjusted under 35 U.S.C. 154(b) by 447 days.

(21) Appl. No.: 15/759,185

(22) PCT Filed: Jan. 14, 2016

(86) PCT No.: PCT/KR2016/000392
§ 371 (c)(1),
(2) Date: Mar. 9, 2018

(87) PCT Pub. No.: WO2017/051997
PCT Pub. Date: Mar. 30, 2017

(65) Prior Publication Data

US 2018/0257122 A1 Sep. 13, 2018

(30) Foreign Application Priority Data

Sep. 23, 2015 (KR) ..... 10-2015-0134340

(51) Int. Cl.
*B21D 22/20* (2006.01)
*B21D 37/16* (2006.01)
(Continued)

(52) U.S. Cl.
CPC ..... *B21D 22/208* (2013.01); *B21B 3/00* (2013.01); *B21D 22/20* (2013.01); *B21D 37/16* (2013.01);
(Continued)

(58) Field of Classification Search
CPC ..... B21D 22/20–30; C21D 8/00; C21D 8/04; C21D 8/041
See application file for complete search history.

(56) References Cited

U.S. PATENT DOCUMENTS

2015/0361532 A1* 12/2015 Nam ..... C22C 38/02 420/106

FOREIGN PATENT DOCUMENTS

CN 104838030 A 8/2015
JP 2004-058082 A * 2/2004 ..... B21D 22/20
(Continued)

OTHER PUBLICATIONS

Office Action dated Jul. 9, 2019, for the corresponding Chinese Patent Application No. 201680052945.5 and English translation thereof.
(Continued)

*Primary Examiner* — Keith Walker
*Assistant Examiner* — Benjamin C Anderson
(74) *Attorney, Agent, or Firm* — Locke Lord LLP

(57) ABSTRACT

A method for producing a molded article includes the steps of: preparing a first steel plate and a second steel plate. The first steel plate and the second steel plate are joined to each other, thereby preparing a joined steel plate. The joined steel plate is heated at a temperature between 910° C. and 950° C. The heated joined steel plate is then subjected to hot-press molding, thereby preparing an intermediate molded article;
(Continued)

and cooling the intermediate molded article, wherein the first steel plate has a tensile strength (TS) higher than that of the second steel plate.

4 Claims, 8 Drawing Sheets

(51) Int. Cl.

| | |
|---|---|
| ***B21D 53/88*** | (2006.01) |
| ***C22C 38/28*** | (2006.01) |
| ***C21D 8/04*** | (2006.01) |
| ***C22C 38/26*** | (2006.01) |
| ***C22C 38/38*** | (2006.01) |
| ***C22C 38/32*** | (2006.01) |
| ***B21B 3/00*** | (2006.01) |

(52) U.S. Cl.
CPC ..... *B21D 53/88* (2013.01); *C21D 8/04* (2013.01); *C22C 38/26* (2013.01); *C22C 38/28* (2013.01); *C22C 38/32* (2013.01); *C22C 38/38* (2013.01); *C21D 8/0426* (2013.01); *C21D 8/0436* (2013.01); *C21D 8/0473* (2013.01)

(56) References Cited

FOREIGN PATENT DOCUMENTS

| | | | | | |
|---|---|---|---|---|---|
| JP | 2004-058082 | A | | 2/2004 | |
| JP | 2005-126733 | A | * | 5/2005 | ..... C21D 9/48 |
| JP | 2005-126733 | A | | 5/2005 | |
| JP | 2006-212663 | A | | 8/2006 | |
| JP | 2009287114 | A | | 12/2009 | |
| JP | 2012-107319 | A | | 6/2012 | |
| KR | 2012-0033009 | A | * | 4/2012 | ..... B21B 3/02 |
| KR | 1020120033009 | A | | 4/2012 | |
| KR | 20120060970 | A | | 6/2012 | |
| KR | 20130002230 | A | | 1/2013 | |
| KR | 10-1318060 | B1 | * | 10/2013 | ..... C21D 8/00 |
| KR | 101318060 | B1 | | 10/2013 | |
| KR | 2014-0083542 | A | * | 7/2014 | ..... B21D 22/02 |
| KR | 20140083542 | A | | 7/2014 | |
| KR | 20140118310 | A | | 10/2014 | |

OTHER PUBLICATIONS

International Search Report issued by the Korean Intellectual Property Office, as ISA, dated Sep. 23, 2015, in corresponding International Patent Application PCT/KR2016/000392.

Office Action dated Mar. 15, 2019, issued in the corresponding Japanese Patent Application No. 2018-509803 and English translation thereof.

Supplementary Search Report dated Apr. 4, 2019, issued for the European Search Report 16848723.9.

* cited by examiner (a) EXAMPLE (b) COMPARATIVE EXAMPLE

MOLDED BODY MANUFACTURING METHOD

CROSS REFERENCE TO RELATED APPLICATIONS

This application is the national phase under 35 U.S.C. § 371 of PCT International Application No. PCT/KR2016/000392, filed Jan. 14, 2016, which claims the benefit of and priority to Korean Patent Application No. 10-2015-013-4340 filed Sep. 23, 2015. The entire contents of this patent application are hereby incorporated by reference herein.

TECHNICAL FIELD

The present invention relates to a method for producing a molded article. More specifically, the present invention relates to a method for producing a molded article which is used as a component for a crash energy absorber.

BACKGROUND ART

A B-pillar, a critical component for an automotive crash energy absorber, is mainly made of a heat-treated steel plate corresponding to a class of 150K or higher. It plays a very important role in assuring a survival space for the driver when a side crash occurs. In addition, a high-toughness steel member which is used as a crash energy absorber undergoes brittle fracture which threatens the safety of the driver, when a side crash occurs. For this reason, a low-toughness steel member is connected to the lower end of the B-pillar, which undergoes brittle fracture, thereby increasing the crash energy absorption ability of the B-pillar. This steel member is referred to as a steel plate for Tailored-Welded Blank (TWB) applications. The steel plate for TWB applications is produced by a hot-rolling process and a cold-rolling process, followed by a hot-press process such as hot stamping.

The prior art related to the present invention is disclosed in Korean Patent No. 1304621 (published on Aug. 30, 2013; entitled "METHOD FOR MANUFACTURING HOT PRESS FORMING PARTS HAVING DIFFERENT STRENGTHS BY AREA").

DISCLOSURE

Technical Problem

In accordance with an embodiment of the present invention, there is provided a method for producing a molded article, which can minimize the variation in properties between different portions of the molded article, which depends on hot-press process parameters.

In accordance with another embodiment of the present invention, there is provided a method for producing a molded article having excellent rigidity and formability.

In accordance with another embodiment of the present invention, there is provided a method for producing a molded article having excellent productivity and economic efficiency.

Technical Solution

One aspect of the present invention is directed to a method for producing a molded article. In an embodiment, the method for producing the molded article includes the steps of: preparing a first steel plate and a second steel plate; joining the first steel plate and the second steel plate to each other, thereby preparing a joined steel plate; heating the joined steel plate at a temperature between 910° C. and 950° C.; subjecting the heated joined steel plate to hot-press molding, thereby preparing an intermediate molded article; and colling the intermediate moded article, wherein the first steel plate has a tensile strength (TS) higher than that of the second steel plate.

In one embodiment, the cooling may include cooling the intermediate molded article at a cooling rate of 50-150°/sec.

In one embodiment, the hot-press molding may include transferring the heated joined steel plate to a hot-press mold within 5-20 seconds.

In one embodiment, the first steel plate may have a tensile strength of 1300-1600 MPa, and the second steel plate may have a tensile strength of 600 MPa or higher.

In one embodiment, the second steel plate may be prepared by a method including the steps of: reheating a steel slab, containing 0.04-0.06 wt % of carbon (C), 0.2-0.4 wt % of silicon (Si), 1.6-2.0 wt % of manganese (Mn), more than 0 wt % but not more than 0.018 wt % of phosphorus (P), more than 0 wt % but not more than 0.003 wt % of sulfur (S), 0.1-0.3 wt % of chromium (Cr), 0.0009-0.0011 wt % of boron (B), 0.01-0.03 wt % of titanium (Ti), 0.04-0.06 wt % of niobium (Nb), and the balance of iron (Fe) and unavoidable impurities, at a temperature of 1,200 to 1,250° C.; hot-rolling the reheated steel slab; coiling the hot-rolled steel slab to prepare a hot-rolled coil; uncoiling the hot-rolled coil, followed by cold rolling, thereby preparing a cold-rolled steel plate; and annealing the cold-rolled steel plate.

In one embodiment, the annealing may include the steps of: heating the cold-rolled steel plate at a temperature between 810° C. and 850° C.; and cooling the heated cold-rolled steel plate at a cooling rate of 10 to 50° C./sec.

In one embodiment, the coiling may be performed at a coiling temperature of 620 to 660° C.

Advantageous Effects

When the method for producing the molded article according to the present invention is used, the variation in physical properties (such as tensile strength and elongation) between different portions of the molded article, which depends on hot-press process parameters, can be minimized, and the produced molded article will have excellent rigidity and formability. As the variation in the properties with a change in the process parameter is minimized, the molded article has excellent productivity and economic efficiency, and thus is suitable for use as a material for a crash energy absorber.

MODE FOR INVENTION

Hereinafter, the present invention will be described in detail. In the following description, the detailed description of related known technology or constructions will be omitted when it may unnecessarily obscure the subject matter of the present invention.

In addition, the terms used in the following description are terms defined taking into consideration their functions in the present invention, and may be changed according to the intention of a user or operator, or according to a usual practice. Accordingly, the definition of these terms must be made based on the contents throughout the specification.

Figure 1:
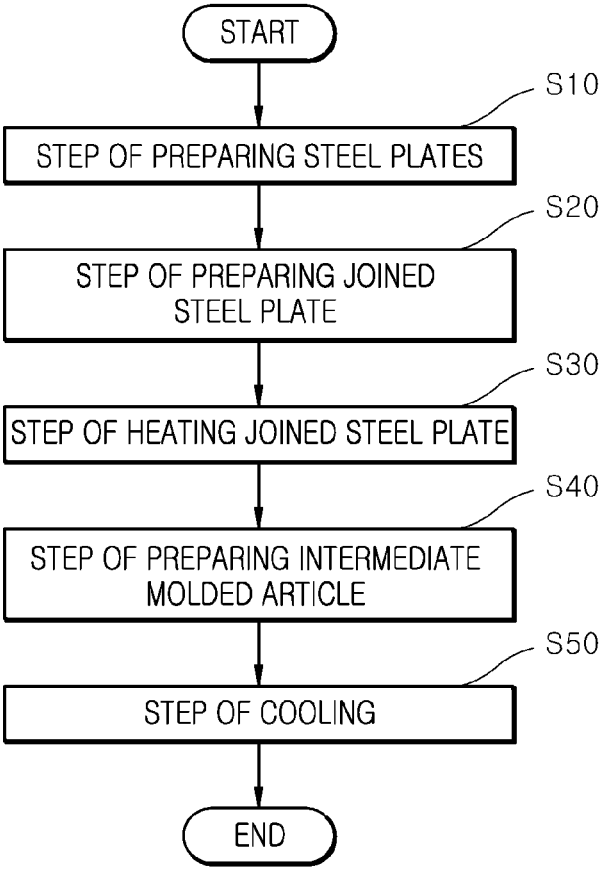
FIG. 1 shows a method for producing a molded article according to an embodiment of the present invention.

One aspect of the present invention is directed to a method for producing a molded article. FIG. 1 shows a method for producing a molded article according to one embodiment of the present invention. Referring to FIG. 1, the method for producing the molded article includes the steps of: (S10) preparing steel plates; (S20) preparing a joined steel plate; (S30) heating the joined steel plate; (S40) preparing an intermediate molded article; and (S50) cooling the intermediate molded article. More specifically, the method for producing the molded article includes the steps of: (S10) preparing a first steel plate and a second steel plate; (S20) joining the first steel plate and the second steel plate to each other, thereby preparing a joined steel plate; (S30) heating the joined steel plate at a temperature between 910° C. and 950° C.; (S40) subjecting the heated joined steel plate to hot-press molding, thereby preparing an intermediate molded article; and (S50) cooling the intermediate molded article.

Hereinafter, each step of the method for producing the molded article according to the present invention will be detail.

(S10) Step of Preparing Steel Plates

This step is a step of preparing a first steel plate and a second steel plate.

The first steel plate that is used in the present invention has a tensile strength (TS) higher than that of the second steel plate. In one embodiment, the first steel plate may be produced using boron steel. Herein, the boron steel is steel containing boron (B) to enhance hardenability. The boron steel has excellent toughness and impact resistance. Particularly, it may have high strength, high hardness and excellent abrasion resistance.

In one embodiment, the first steel plate may contain 0.2-0.3 wt % of carbon (C), 0.2-0.5 wt % of silicon (Si), 1.0-2.0 wt % of manganese (Mn), more than 0 wt % but not more than 0.02 wt % of phosphorus, more than 0 wt % but not more than 0.001 wt % of sulfur (S), more than 0 wt % but not more than 0.05 wt % of copper (Cu), more than 0 wt % but not more than 0.05 wt % of aluminum (Al), 0.01-0.10 wt % of titanium (Ti), 0.1-0.5 wt % of chromium (Cr), 0.1-0.5 wt % of molybdenum (Mo), 0.001-0.005 wt % of boron (B), and the balance of iron (Fe) and unavoidable impurities. When the first steel plate contains alloying elements within the above-described ranges, it may have excellent toughness and impact resistance, and particularly have high strength, high hardness and excellent abrasion resistance.

In one embodiment, the first steel plate may have a tensile strength of 1300-1600 MPa, a yield strength of 900-1200 MPa and an elongation of 4-8%. At the same time, the second steel plate may have a tensile strength of 600-950 MPa, a yield strength of 300-700 MPa and an elongation of 8-18%. In such ranges, the molded article of the present invention can be suitable for use as a crash energy absorber for a car or the like.

In one embodiment, the second steel plate can be prepared by a method comprising: a steel slab reheating step; a hot-rolling step; a coiling step; a cold-rolling step; and an annealing step. More specifically, the second steel plate can be prepared by a method comprising the steps of: reheating a steel slab, containing 0.04-0.06 wt % of carbon (C), 0.2-0.4 wt % of silicon (Si), 1.6-2.0 wt % of manganese (Mn), more than 0 wt % but not more than 0.018 wt % of phosphorus (P), more than 0 wt % but not more than 0.003 wt % of sulfur (S), 0.1-0.3 wt % of chromium (Cr), 0.0009-0.0011 wt % of boron (B), 0.01-0.03 wt % of titanium (Ti), 0.04-0.06 wt % of niobium (Nb), and the balance of iron (Fe) and unavoidable impurities, at a temperature of 1,200 to 1,250° C.; hot-rolling the reheated steel slab; coiling the hot-rolled steel slab to prepare a hot-rolled coil; uncoiling the hot-rolled coil, followed by cold rolling, thereby preparing a cold-rolled steel plate; and annealing the cold-rolled steel plate.

Hereinafter, each step of the method for producing the second steel plate will be described in detail.

Steel Slab Reheating Step

This step is a step of reheating a steel slab containing 0.04-0.06 wt % of carbon (C), 0.2-0.4 wt % of silicon (Si), 1.6-2.0 wt % of manganese (Mn), more than 0 wt % but not more than 0.018 wt % of phosphorus (P), more than 0 wt % but not more than 0.003 wt % of sulfur (S), 0.1-0.3 wt % of chromium (Cr), 0.0009-0.0011 wt % of boron (B), 0.01-0.03 wt % of titanium (Ti), 0.04-0.06 wt % of niobium (Nb), and the balance of iron (Fe) and unavoidable impurities.

Hereinafter, the roles and contents of components contained in the steel slab for the second steel plate will be described in detail.

Carbon (C)

Carbon (C) is a major element that determines the strength and hardness of the steel, and is added for the purpose of ensuring the tensile strength of the steel after the hot-press process.

In one embodiment, carbon may be contained in an amount of 0.04-0.06 wt % based on the total weight of the steel slab. If carbon is added in an amount of less than 0.04 wt %, the properties of the molded article according to the present invention will be deteriorated, and if carbon is added in an amount of more than 0.06 wt %, the toughness of the second steel plate will be reduced.

Silicon (Si)

Silicon (Si) serves as an effective deoxidizer, and is added as a major element to enhance ferrite formation in the base.

In one embodiment, silicon may be contained in an amount of 0.2-0.4 wt % based on the total weight of the steel slab. If silicon is contained in an amount of less than 0.2 wt %, the effect of addition thereof will be insignificant, and if silicon is contained in an amount of more than 0.4 wt %, it can reduced the toughness and formality of the steel, thus reducing the forging property and processability of the steel.

Manganese (Mn)

Manganese (Mn) is added for the purpose of increasing hardenability and strength during heat treatment.

In one embodiment, manganese is contained in an amount of 1.6-2.0 wt % based on the total weight of the steel slab. If manganese is contained in an amount of less than 1.6 wt %, hardenability and strength can be reduced, and if manganese is contained in an amount of more than 2.0 wt %, ductility and toughness can be reduced due to manganese segregation.

Phosphorus (P)

Phosphorus (P) is an element that easily segregates and reduces the toughness of steel. In one embodiment, phosphorus (P) may be contained in an amount of more than 0 wt % but not more than 0.018 wt % based on the total weight of the steel slab. When phosphorus is contained in an amount within this range, reduction in the toughness of the steel can be prevented. If phosphorus is contained in an amount of more than 0.018 wt %, it can cause cracks during the process, and can form an iron phosphide which can reduce toughness.

Sulfur (S)

Sulfur (S) is an element that reduces processability and physical properties. In one embodiment, sulfur may be contained in an amount of more than 0 wt % but not more than 0.003 wt % based on the total weight of the steel slab. If sulfur is contained in an amount of more than 0.003 wt %, it can reduce hot processability, and can form large inclusions which can cause surface defects such as cracks.

Chromium (Cr)

Chromium (Cr) is added for the purpose of improving the hardenability and strength of the second steel plate. In one embodiment, chromium is contained in an amount of 0.1-0.3 wt % based on the total weight of the steel slab. If chromium is contained in an amount of less than 0.1 wt %, the effect of addition of chromium will be insufficient, and if chromium is contained in an amount of more than 0.3 wt %, the toughness of the second steel plate can be reduced.

Boron (B)

Boron is added for the purpose of compensating for hardenability, instead of the expensive hardening element molybdenum, and has the effect of refining grains by increasing the austenite grain growth temperature.

In one embodiment, boron may be contained in an amount of 0.0009-0.0011 wt % based on the total weight of the steel slab. If boron is contained in an amount of less than 0.0009 wt %, the hardening effect will be insufficient, and if boron is contained in an amount of more than 0.0011 wt %, the risk of reducing the elongation of the steel can increase.

Titanium (Ti)

Titanium (Ti) forms precipitate phases such as Ti(C,N) at high temperature, and effectively contributes to austenite grain refinement. In one embodiment, titanium is contained in an amount of 0.01-0.03 wt % based on the total weight of the steel slab. If titanium is contained in an amount of less than 0.01 wt %, the effect of addition thereof will be insignificant, and if titanium is contained in an amount of more than 0.03 wt %, it can cause surface cracks due to the production of excessive precipitates.

Niobium (Nb)

Niobium (Nb) is added for the purpose of reducing the martensite packet size to increase the strength and toughness of steel.

In one embodiment, niobium is contained in an amount of 0.04-0.06 wt % based on the total weight of the steel slab. If niobium is contained in an amount of less than 0.04 wt %, the effect of refining grains will be insignificant, and if niobium is contained in an amount of more than 0.06 wt %, it can form coarse precipitates, and will be disadvantageous in terms of the production cost.

In one embodiment, the steel slab may be heated at a slab reheating temperature (SRT) between 1,200° C. and 1,250° C. At the above-described slab reheating temperature, homogenization of the alloying elements is advantageously achieved. If the steel slab is reheated at a temperature lower than 1,200° C., the effect of homogenizing the alloying elements will be reduced, and if the steel slab is reheated at a temperature higher than 1,250° C., the process cost can increase. For example, the steel slab may be heated at a slab reheating temperature between 1,220° C. and 1,250° C.

Hot-Rolling Step

This step is a step of hot-rolling the reheated steel slab at a finish-rolling temperature (FDT) of 860° C. to 900° C. When the reheated steel slab is hot-rolled at the above-described finish-rolling temperature, both the rigidity and formability of the second steel plate can be excellent.

Coiling Step

This step is a step of coiling the hot-rolled steel slab to prepare a hot-rolled coil. In one embodiment, the hot-rolled steel slab can be coiled at a coiling temperature (CT) between 620° C. and 660° C. In one embodiment, the hot-rolled steel slab may be cooled to the above-described coiling temperature, and then coiled. When the above-described coiling temperature is used, the low-temperature phase fraction due to superheating will increase to prevent the strength of the steel from being increased by addition of Nb, and at the same time, a rolling load during cold rolling can be prevented. In one embodiment, the cooling may be performed by shear quenching.

Cold-Rolling Step

This step is a step of uncoiling the hot-rolled coil, followed by cold-rolling to prepare a cold-rolled steel plate. In one embodiment, the hot-rolled coil may be uncoiled, and then pickled, followed by cold rolling. The pickling may be performed for the purpose of removing scales formed on the surface of the hot-rolled coil.

In one embodiment, the cold rolling may be performed at a reduction ratio of 60-80%. When the cold rolling is performed at this reduction ratio, the hot-rolled structure will be less deformed, and the steel plate will have excellent elongation and formability.

Annealing Step

This step is a step of annealing the cold-rolled steel plate. In one embodiment, the annealing may include a heating step and a cooling step. More specifically, the annealing may include the steps of: heating the cold-rolled steel plate at a temperature between 810° C. and 850° C.; and cooling the heated cold-rolled steel plate at a rate of 10-50° C./sec.

When the annealing is performed under the above-described conditions, high process efficiency and excellent strength and formability can all be achieved.

(S20) Step of Preparing Joined Steel Plate

Figure 2:
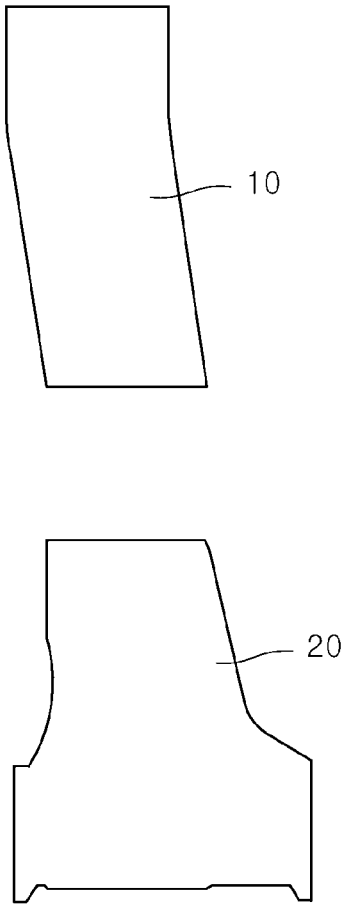
FIG. 2 shows a process of preparing a joined steel plate according to the present invention.

This step is a step of preparing a joined steel plate by joining the first steel plate 10 and the second steel plate 20 to each other. FIG. 2 is a process of joining the first steel plate 10 and the second steel plate 20 to each other to prepare a joined steel plate 30, and FIG. 3 shows the joined steel plate 30 obtained by joining the first steel plate 10 to the second steel plate 20.

Figure 3:
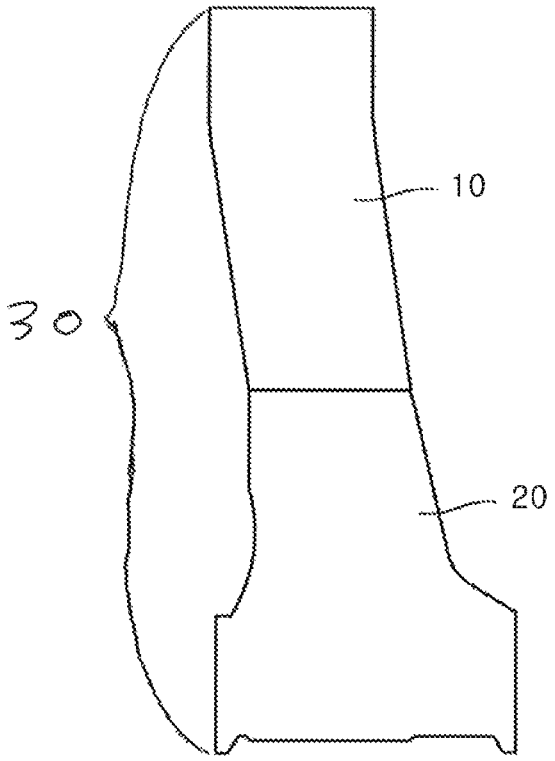
FIG. 3 shows a joined steel plate according to the present invention.

Referring to FIGS. 2 and 3, in one embodiment, a first steel plate 10 and a second steel plate 20 may be aligned to abut each other, and then joined to each other by laser welding, thereby preparing a joined steel plate 30. In one embodiment, the first steel plate 10 and the second steel plate 20 may have different thicknesses. For example, the second steel plate 20 may be thicker than the first steel plate 10. Under the above-described conditions, stable crash energy absorption performance can be ensured.

Referring to FIGS. 2 and 3, the first steel plate 10 may constitute the upper portion of the joined steel plate 30, and the second steel plate 20 may constitute the lower portion of the joined steel plate 30.

(S30) Step of Heating Joined Steel Plate

This step is a step of heating the joined steel plate at a temperature between 910° C. and 950° C. In one embodiment, the joined steel plate 30 may be heated at a temperature of 910° C. to 950° C. for 4-6 minutes.

In the above-described ranges, the formability of the joined steel plate 30 can be ensured. If the heating temperature is lower than 910° C., it will be difficult to ensure the formability of the joined steel plate 30, and if the heating temperature is higher than 950° C., productivity will be reduced, and disadvantages in terms of energy consumption will arise.

If the heating time is shorter than 4 minutes, it will be difficult to ensure the formability of the joined steel plate 30, and if the heating time is longer than 6 minutes, disadvantages in terms of energy consumption will arise.

(S40) Step of Rearing Intermediate Molded Article

This step is a step of subjecting the heated joined steel plate 30 to hot-press molding to prepare an intermediate molded article.

In one embodiment, in the hot-press molding, the heated joined steel plate 30 may be transferred to a hot-press mold within 5-20 seconds and subjected to hot-press molding therein. When the heated joined steel plate 30 is transferred within the above-described time range, the variation in properties between different positions of the joined steel plate 30 can be minimized. For example, the transfer time may be 9-11 seconds.

(S50) Cooling Step

This step is a step of cooling the intermediate molded article. In one embodiment, the cooling may be performed by cooling the intermediate molded article at a rate of 50 to 150° C./sec.

When the intermediate molded article is cooled at the above-described cooling rate, the microstructures of the intermediate molded article can be transformed into a complete martensite phase, and thus the intermediate molded article can have excellent physical properties such as toughness.

When the method for producing the molded article according to the present invention is used, the variation in physical properties (such as tensile strength and elongation) between different portions of the molded article, which depends on hot-press process parameters, can be minimized, and the produced molded article will have excellent rigidity and formability, and the toughness of the molded article can also be improved. As the variation in the properties with a change in the process parameter is minimized, the molded article has excellent productivity and economic efficiency, and thus is suitable for use as a material for a crash energy absorber.

Hereinafter, the construction and operation of the present invention will be described in further detail with reference to preferred examples. However, these examples are only preferred examples of the present invention and are not intended to limit the scope of the present invention in any way.

Example and Comparative Example

A first steel plate was prepared. The first steel plate contains 0.2-0.3 wt % of carbon (C), 0.2-0.5 wt % of silicon (Si), 1.0-2.0 wt % of manganese (Mn), more than 0 wt % but not more than 0.02 wt % of phosphorus, more than 0 wt % but not more than 0.001 wt % of sulfur (S), more than 0 wt % but not more than 0.05 wt % of copper (Cu), more than 0 wt % but not more than 0.05 wt % of aluminum (Al), 0.01-0.10 wt % of titanium (Ti), 0.1-0.5 wt % of chromium (Cr), 0.1-0.5 wt % of molybdenum (Mo), 0.001-0.005 wt % of boron (B), and the balance of iron (Fe) and unavoidable impurities, and has a tensile strength of 1,510 MPa.

A steel slab containing the alloying elements and their contents shown in Table 1, and the balance of iron (Fe) and unavoidable impurities, was reheated at a slab reheating temperature of 1,220° C., and hot-rolled at a finish-rolling temperature of 880° C., and then coiled at a coiling temperature of 650° C. to prepare a hot-rolled coil. The hot-rolled coil was uncoiled, pickled, and then cold-rolled to prepare a cold-coiled steel plate. The cold-rolled steel plate was heated at 810° C., and then cooled at a rate of 33° C./sec, followed by annealing, thereby preparing a second steel plate.

As shown in FIGS. 2 and 3, the first steel plate 10 and the second steel plate 20 were joined to each other by laser welding, thereby preparing a joined steel plate 30. The joined steel plate 30 was heated at 930° C. for 5 minutes. The heated joined steel plate was transferred to a hot-press mold within 10 seconds and subjected to hot-press molding therein, thereby preparing an intermediate molded article. The intermediate molded article was cooled to a rate of 50 to 150° C./sec, thereby producing a molded article.

TABLE 1

| | Elements (unit: wt %) | | | | | | | | | |
|---|---|---|---|---|---|---|---|---|---|---|
| | C | Si | Mn | P | S | Cr | B | Ti | Nb | Mo |
| Example | 0.05 | 0.3 | 1.8 | 0.015 | 0.002 | 0.15 | 0.001 | 0.02 | 0.05 | — |
| Comparative Example | 0.07 | 0.03 | 1.8 | 0.015 | 0.002 | 0.05 | 0.0009 | 0.06 | 0.05 | 0.15 |

For the molded articles of the Example and the Comparative Example, the tensile strength, yield strength and elongation of a portion corresponding to the second steel plate were measured, and the results of the measurement are shown in Table 2 below.

TABLE 2

| | Tensile strength (MPa) | Yield strength (MPa) | Elongation (%) |
|---|---|---|---|
| Example | 780 | 227 | 14% |
| Comparative Example | 695 | 225 | 13% |

Figure 4A:
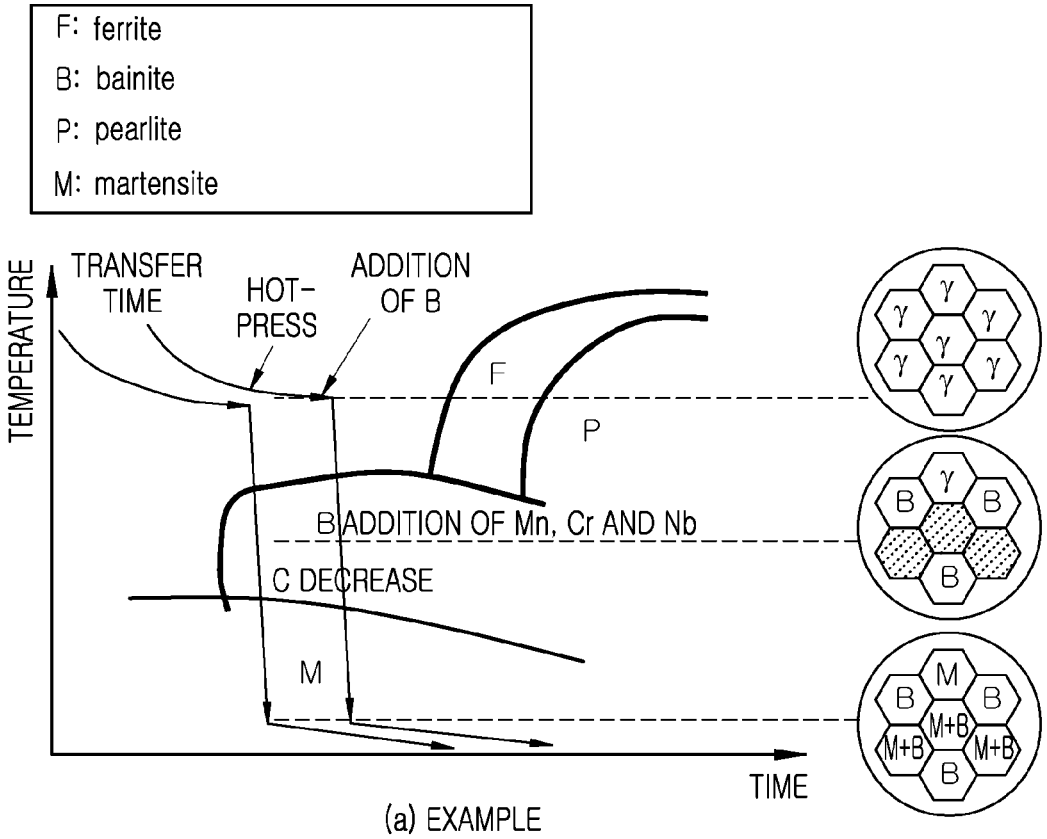
FIG. 4A shows the change in final microstructures as a function of hot-press mold transfer time in an Example of the present invention.
Figure 4B:
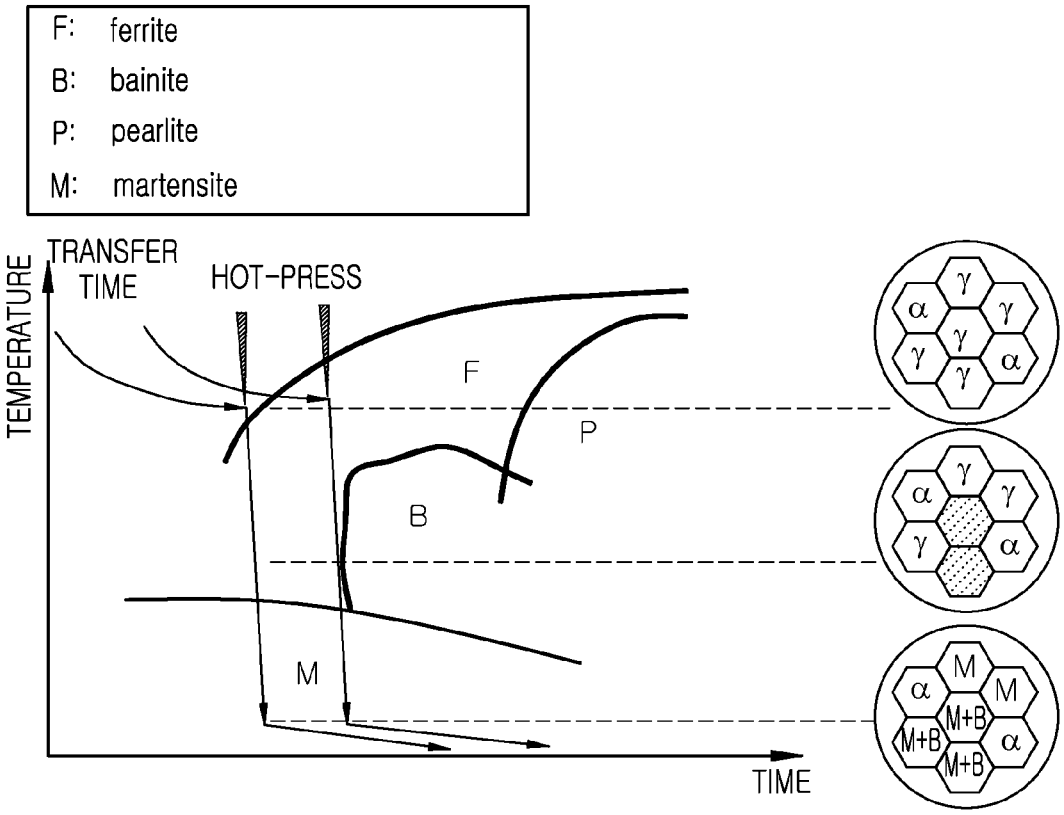
FIG. 4B shows the change in final microstructures as a function of hot-press mold transfer time in a Comparative Example for the present invention.

FIG. 4A shows the change in final microstructures of a portion corresponding to the second steel plate as a function of hot-press mold transfer time in the Example of the present invention, and FIG. 4B shows the change in final microstructures of a portion corresponding to the second steel plate as a function of hot-press mold transfer time in the Comparative Example.

Referring to Table 2 above and FIGS. 4A and 4B, it can be seen that the martensite and ferrite fractions in the second steel plate of the Comparative Example changed rapidly depending on a change in the hot-press mold transfer time after heating of the joined steel plate and depending on the cooling rate of the intermediate molded article and the mold, compared to that of the Example, indicating that the variation in properties between different portions of the molded article of the Comparative Example highly likely to occur, and the molded article of the Comparative Example is unsuitable for use as a component for a automotive crash energy absorber.

On the contrary, in the case of the second steel plate of the Example, it can be seen that the variation in properties between different portions of the molded article can be prevented, as a result of adding boron (B), chromium (Cr) and niobium (Nb) to increase hardenability in order to prevent the variation in properties of the molded article from occurring depending on process parameters such as difficult-to-control hot-press mold transfer time and as a result of reducing the content of carbon (C) to reduce the martensite fraction to thereby stably ensure bainite structures within the range of the hot-press process parameter (hot-press mold transfer time). In addition, it can be seen that the second steel plate of the Example shows excellent toughness without having to contain expensive molybdenum (Mo), and thus has excellent economic efficiency, compared to the second steel plate of the Comparative Example.

Figure 5:
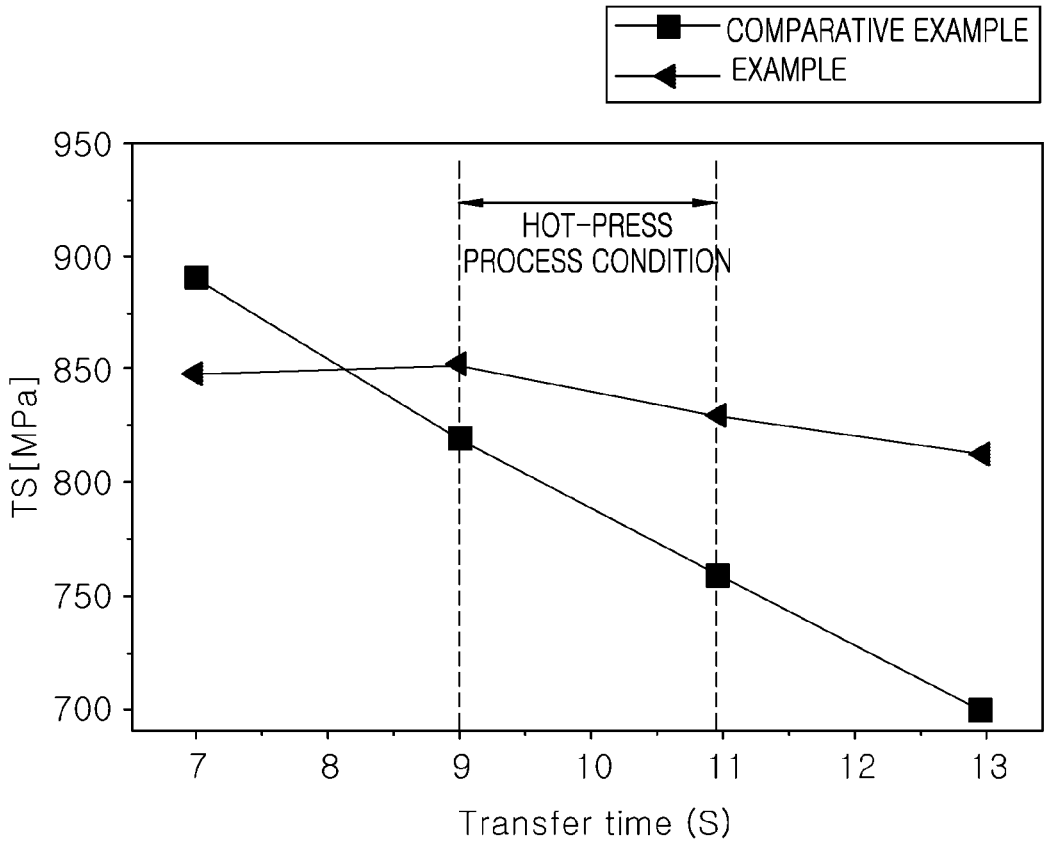
FIG. 5 is a graph showing the change in tensile strength as a function of hot-press mold transfer time in an Example of the present invention and the Comparative Example for the present invention.

FIG. 5 shows the change in tensile strength of a portion corresponding to the second steel plate of the molded article of each of the Example and the Comparative Example as a function of the hot-press mold transfer time. Referring to FIG. 5, it can be seen that the Comparative Example showed a great change in the tensile strength with a change in the transfer time, compared to the Example, and that the Example showed a small change in the tensile strength with a change in the transfer time.

Figure 6:
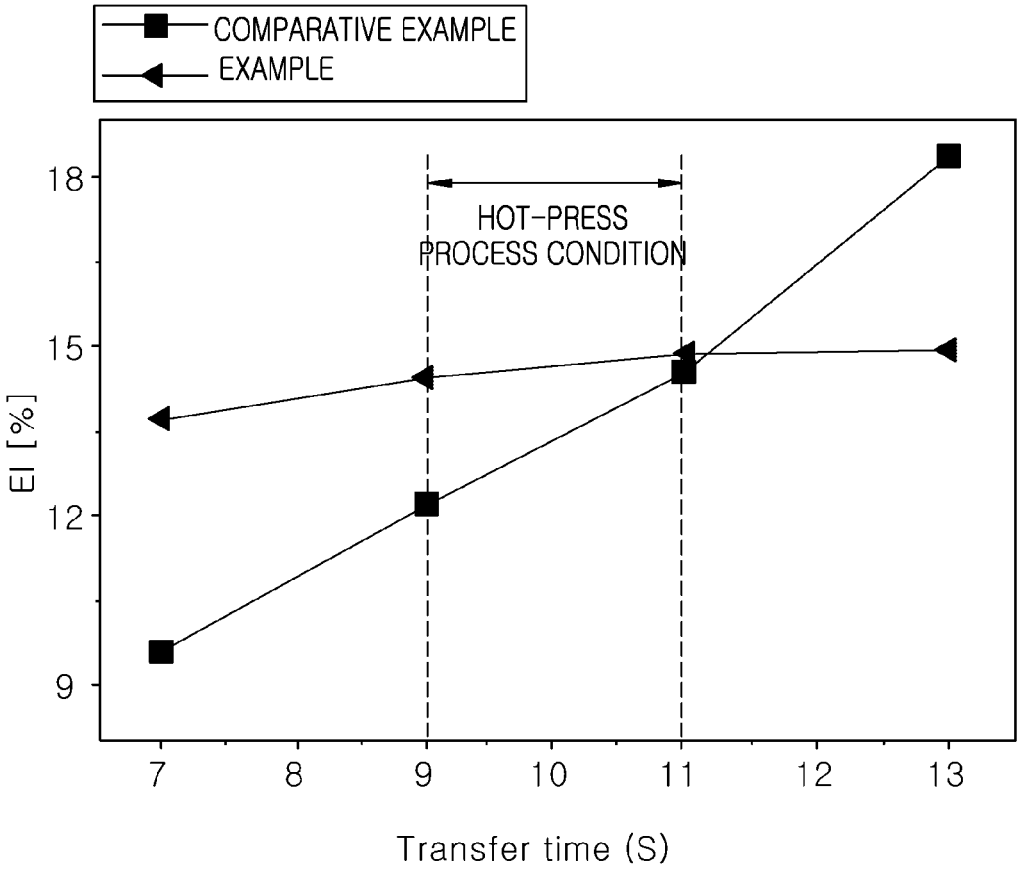
FIG. 6 is a graph showing the change in elongation as a function of hot-press mold transfer time in an Example of the present invention and the Comparative Example for the present invention.

FIG. 6 shows the change in elongation of a portion corresponding to the second steel plate of the molded article of each of the Example and the Comparative Example as a function of the hot-press mold transfer time. Referring to FIG. 5, it can be seen that in the Comparative Example, the change in the elongation with a change in the transfer time was greater than that in the Example, and in the Example, the change in the elongation with a change in the transfer time was small.

Figure 7:
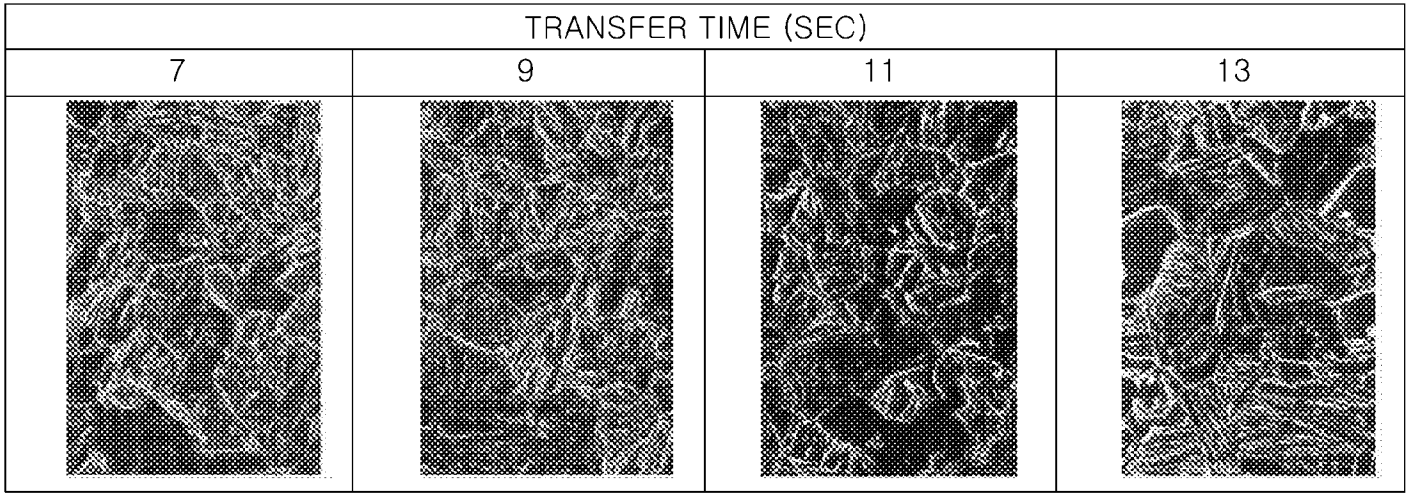
FIG. 7 shows surface structures at varying hot-press mold transfer times in an Example of the present invention.

FIG. 7 shows the surface structures of a portion corresponding to the second steel plate of the Example at varying hot-press mold transfer times. Referring to FIG. 7, it can be seen that, in the Example, the change in the microstructure with a change in the transfer time was small.

Simple modifications or alterations of the present invention can be easily made by those skilled in the art, and such modifications or alternations are all considered to fall within the scope of the present invention.

The invention claimed is:

1. A method for producing a molded article, comprising the steps of:

preparing a first steel plate and a second steel plate;

joining the first steel plate and the second steel plate to each other, thereby preparing a joined steel plate;

heating the joined steel plate at a temperature between 910° C. and 950° C.;

subjecting the heated joined steel plate to hot-press molding, thereby preparing an intermediate molded article; and cooling the intermediate molded article, wherein the first steel plate has a tensile strength (TS) higher than that of the second steel plate, wherein the first steel plate consists of 0.2-0.3 wt % of carbon (C), 0.2-0.5 wt % of silicon (Si), 1.0-2.0 wt % of manganese (Mn), more than 0 wt % but not more than 0.02 wt % of phosphorus (P), more than 0 wt % but not more than 0.001 wt % of sulfur (S), more than 0 wt % but not more than 0.05 wt % of copper (Cu), more than 0 wt % but not more than 0.05 wt % of aluminum (Al), 0.01-0.10 wt % of titanium (Ti), 0.1-0.5 wt % of chromium (Cr), 0.1-0.5 wt % of molybdenum (Mo), 0.001-0.005 wt % of boron (B), and the balance of iron (Fe) and unavoidable impurities, the second steel plate is prepared by a method including the steps of:

reheating a steel slab, consisting of 0.04-0.06 wt % of carbon (C), 0.2-0.4 wt % of silicon (Si), 1.6-2.0 wt % of manganese (Mn), more than 0 wt % but not more than 0.018 wt % of phosphorus (P), more than 0 wt % but not more than 0.003 wt % of sulfur (S), 0.1-0.3 wt % of chromium (Cr), 0.0009-0.0011 wt % of boron (B), 0.01-0.03 wt % of titanium (Ti), 0.04-0.06 wt % of niobium (Nb), and a balance of iron (Fe) and unavoidable impurities, at a temperature between 1,200° C. and 1,250° C.;

hot-rolling the reheated steel slab;

coiling the hot-rolled steel slab to prepare a hot-rolled coil;

uncoiling the hot-rolled coil, followed by cold rolling, thereby preparing a cold-rolled steel plate; and annealing the cold-rolled steel plate, wherein the hot-press molding comprises transferring the heated joined steel plate to a hot-press mold with a transfer time between 5 and 20 seconds to ensure bainite structures of the second steel plate, wherein the first steel plate has a tensile strength of 1300-1600 MPa, and the second steel plate has a tensile strength of 600 MPa or higher.

2. The method of claim 1, wherein the cooling comprises cooling the intermediate molded article at a cooling rate of 50-150° C./sec.

3. The method of claim 1, wherein the annealing comprises the steps of:

heating the cold-rolled steel plate at a temperature between 810° C. and 850° C.; and cooling the heated cold-rolled steel plate at a cooling rate of 10 to 50° C./sec.

4. The method of claim 1, wherein the coiling is performed at a coiling temperature of 620 to 660° C.

* * * * *